United States Patent [19]

Sakamaki et al.

[11] Patent Number: 4,561,835

[45] Date of Patent: Dec. 31, 1985

[54] FLOATING ROTARY SLEEVE OF A ROTARY COMPRESSOR

[75] Inventors: Hiroshi Sakamaki, Utsunomiya; Susumu Sugishita, Hanyu; Yukio Horikoshi, Kazo, all of Japan

[73] Assignee: Nippon Piston Ring Kabushiki Kaisha, Tokyo, Japan

[21] Appl. No.: 611,369

[22] Filed: May 17, 1984

[30] Foreign Application Priority Data

May 20, 1983 [JP] Japan ..... 58-087616

[51] Int. Cl.[4] ..... F04C 18/348

[52] U.S. Cl. ..... 418/173; 384/278

[58] Field of Search ..... 418/172, 173, 174, 270, 418/83; 308/DIG. 1; 384/107, 109, 110, 278, 114, DIG. 14; 433/132

[56] References Cited

U.S. PATENT DOCUMENTS 3,128,988 4/1964 Mandroian ..... 384/110

3,210,848 10/1965 Bizzigotti ..... 384/110

3,447,841 6/1969 Fernlund ..... 384/109

FOREIGN PATENT DOCUMENTS 2107790 5/1983 United Kingdom ..... 418/173

*Primary Examiner*—Leonard E. Smith

*Attorney, Agent, or Firm*—Birch, Stewart, Kolasch & Birch

[57] ABSTRACT

The rotary compressor according to the present invention is constructed such that a rotary sleeve is rotatably and floatingly, suspended within a central housing by means of a pneumatic bearing chamber. A rotor, into and out of which a vane can freely move, is rotatably housed within said rotary sleeve. On the periphery of said rotary sleeve a taper is formed continuously extending from both ends toward the axial center. Such a construction ensures inhibition of frictional heat generation in the vane and non-lubricated rotation.

5 Claims, 5 Drawing Figures

FLOATING ROTARY SLEEVE OF A ROTARY COMPRESSOR

BACKGROUND OF THE INVENTION

1. Field of the Invention

The present invention relates to a rotary compressor in which a rotary sleeve is floatingly suspended in the central housing and a rotor with a vane is rotatably housed within said rotary sleeve. More specifically, the present invention is directed to the floating-suspension mechanism of the rotary sleeve.

2. Description of the Prior Art

Generally speaking, the vane-type rotary compressor is required to have a different performance depending on the intended use. For instance, an auto-engine supercharger is required to withstand high pressure and a wide range of rpms.

For this purpose it is effective to provide between the central housing and the vaned rotor, a rotary sleeve floatingly suspended relative to said central housing through a pneumatic bearing chamber, and to minimize the friction between the vane and the rotary sleeve by making the rotary sleeve rotate together with said rotor. Such an arrangement suppresses heat generation due to the rotational friction of the vane, realizing a non-lubricated rotation and large flow rate in a wide range of rpms.

In this rotary compressor the rotary sleeve, floatingly suspended, must be able to rotate smoothly within the central housing. The rotary sleeve tends to be thermally deformed to a hourglass shape as the result of its inside surface being heated by adiabatic compression of the gas with both of its ends being bent outwardly.. To prevent such a deformation it is important to avoid as far as possible, contact of both ends with the central housing. Furthermore, the rotary sleeve is more loaded at its center and less and less loaded toward its ends and therefore both ends of the rotary sleeve should not be allowed to displace and touch the inside surface of the central housing, resulting in a seizure.

SUMMARY OF THE INVENTION

The object of the present invention is to provide a rotary compressor in which the rotary sleeve can rotate smoothly with no wear nor seizure due to contact between the rotary sleeve and the central housing.

To accomplish the above object, the rotary compressor according to the present invention is constituted such that the rotary sleeve is floatingly suspended to be freely rotatable within the central housing by means of a pneumatic bearing chamber. A rotor with a vane free to move in and out is rotatably installed within the rotary sleeve. From the ends toward the axial center of the rotary sleeve there are provided tapers continuing circumferentially at the outside surface of the rotary sleeve.

Such a constitution suppresses heat generation due to vane friction and realizes a non-lubricated rotation. Moreover, even if a thermal deformation of an outward bending at both ends of the rotary sleeve occurs, the rotary sleeve can be prevented from coming into contact with the inside surface of the central housing because both ends of the rotary sleeve are tapered. And even if the rotary sleeve is displaced, the taper makes it difficult for the ends to come into contact with the central housing. Even if such a contact occurs, the continuous peripheral taper minimizes the frictional resistance, thereby successfully preventing wear, scuffing or seizure.

BRIEF DESCRIPTION OF THE DRAWINGS

The above and other objects, features and advantages of the invention will become apparent and more readily appreciated from the following detailed description of exemplary embodiments of the present invention, taken in conjunction with the accompanying drawings, of which.

DETAILED DESCRIPTION OF THE PREFERRED EMBODIMENTS

Figure 1:
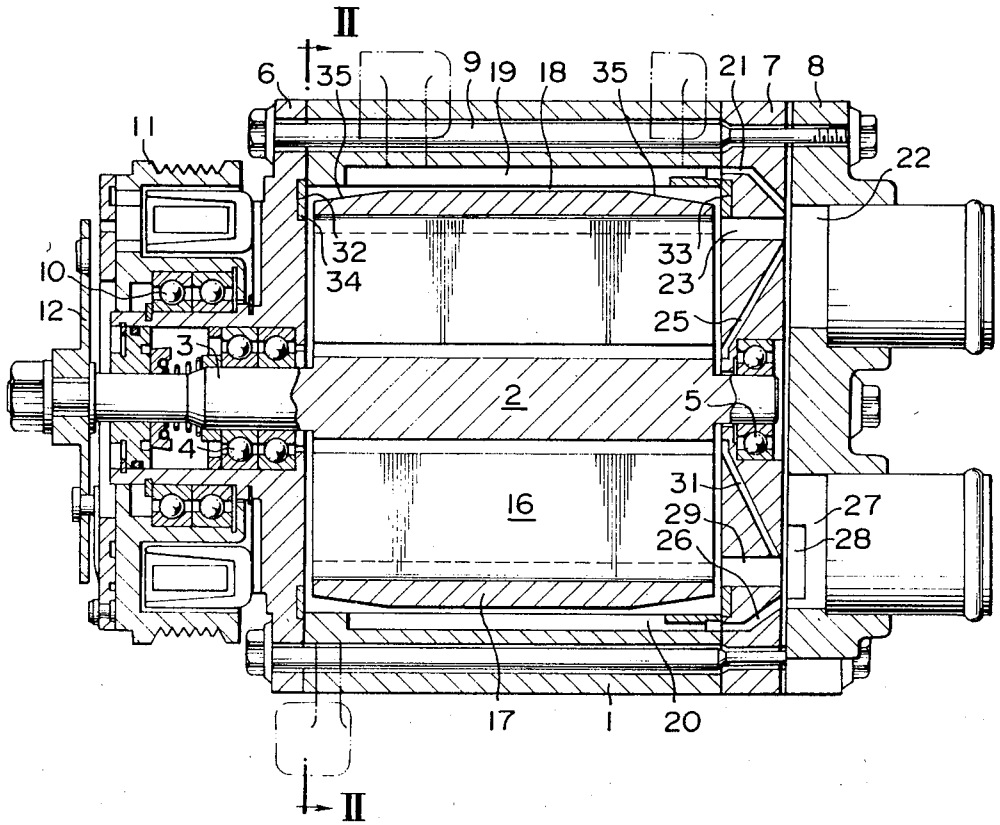
FIG. 1 is a sectional view of a rotary compressor in one embodiment of the present invention.

The present invention will now be described by referring to the drawings.

FIGS. 1 to 4 illustrate a rotary compressor in one embodiment of the present invention. In these figures, 1 is the central housing and 2 is the rotor housed in the central housing 1. The rotor 2 is rotatably supported by the bearings 4, 5 at the rotating shaft 3 integrated to the rotor 2. The bearings 4 and 5 are respectively fitted to the front side housing 6 and to the rear side housing 7. The front side housing 6, the rear side housing 7 and the rear cover 8 provided outside of the rear side housing 7 are fastened to the central housing 1 by means of a bolt 9 extending through the central housing 1. The rotating shaft 3 of the rotor 2 is connected via the rotating member 12 to a pulley 11 rotatably supported by the front side housing 6 via a bearing 10. A rotating force is transmitted to the pulley 11 via a drive mechanism, not shown, for example, an engine crankshaft.

Figure 2:
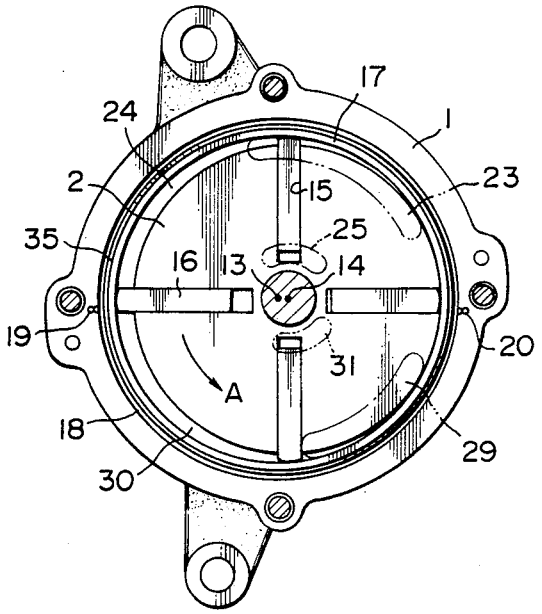
FIG. 2 is a sectional view taken along the line II—II of FIG. 1.

The rotor 2, as indicated in FIG. 2, has its axial center 14 located at a position eccentric to the axial center 13 of the central housing 1. The rotor 2 has a plurality of vane grooves 15 with a bottom which extends in the radial direction of the rotor 2 and opens toward the inside of the central housing 1. A vane 16 can move freely into and out of the vane groove 15 in the direction toward the inside surface of the central housing 1.

Between the vane 16 and the inside surface of the central housing 1 there is rotatably located a rotary sleeve 17 consisting of a ring member with substantially the same axial center as the axial center 13 of the central housing 1. The clearance between the outside surface of the rotary sleeve 17 and the inside surface of the central housing 1 constitutes a pneumatic bearing chamber 18. The pneumatic bearing chamber 18 extends over the entire outside of the rotary sleeve 17 and the rotary sleeve 17 is floatingly suspended by means of the pneumatic bearing chamber 18 in the central housing 1. Into the pneumatic bearing chamber 18 opens a gas inlet 19 and a gas outlet 20 which are formed like a straight slit on the inside of the central housing 1 extending parallel to the axis of the rotary sleeve 17. The inlet 19 may be a zigzag slit or an isosceles triangle with its apex pointing in the rotating direction. The inlet 19 communicates with a suction chamber 22 formed within the rear cover 8 through a gas supply hole 21 formed in the rear side housing 7.

The suction chamber 22 is formed in the rear side housing 7 and, as shown in FIG. 2, it communicates with the suction side work chamber 24, located between the rotor 2 and the rotary sleeve 17, through a suction hole 23 opening at the rotor side in the form of an arc. The suction chamber 22 also communicates with a space formed between the bottom of the vane groove 15 and the vane 16 through a communication hole 25 opening at the rotor side in the form of an arc.

Meanwhile the outlet 20 communicates with an exhaust chamber 27, formed in the rear cover 8, through a gas discharge hole 26 formed in the rear side housing 7. The exhaust chamber 27 communicates with an exhaust hole 29, formed in the rear side housing 7, through an exhaust valve 28. The exhaust hole 29 opens in an arc at the rotor side and communicates with the exhaust side work chamber 30 located between the rotor 2 and the rotary sleeve 17, as well as with a space formed between the bottom of the vane groove 15 and the vane 16 through a communication hole 31 opening in an arc at the rotor side.

As illustrated in FIG. 2, the gas inlet 19 and the gas outlet 20 are respectively located at the start and at the end of the exhaust side work area as viewed from the rotating direction A of the rotor 2.

On the inside of the front side housing 6 and the rear side housing 7 respectively, opposed to the two ends of the rotary sleeve 17 are formed annular grooves 32, 33 which open to the side of the rotary sleeve 17. To the grooves 32 and 33 is fitted an annular non-lubricated sliding member 34. The sliding member 34 is fabricated of a self-lubricating carbon base material.

Figure 3:
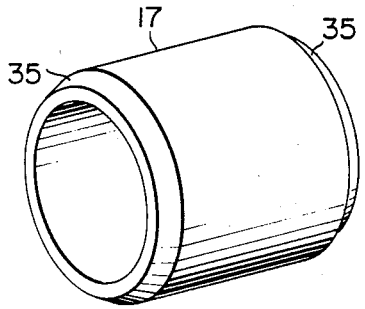
FIG. 3 is an a perspective view of a rotary sleeve taken out of the rotary compressor of FIG. 1.
Figure 4:
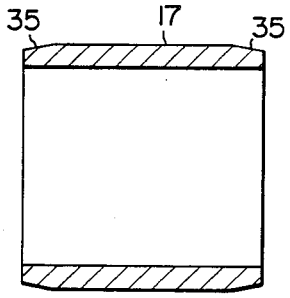
FIG. 4 is a sectional view of the rotary sleeve of FIG. 3.

Returning to the description of the rotary sleeve 17, the rotary sleeve 17 has, as seen particularly in FIGS. 3 and 4, tapers 35 formed on the outside surface of the rotary sleeve 17. The tapers 35 extend from the two ends to the axial center of the rotary sleeve 17, the radius of the tapers 35 gradually diminishing from the axial center toward the two ends.

The effective inclination of the taper 35 is less than 5/100. The thickness of the rotary sleeve 17 at the two ends is set at over ½ of the thickness of the central non-tapered portion and the lengths of the tapers 35 at both ends are set at less than ½ of the length of the rotaty sleeve otherwise the two tapers 35, 35 would contact each other.

A wider taper would make the thicknesses of the two ends so small that a problem would occur with the material strength or the posture of the rotary sleeve would be destabilized. The taper 35 is formed continuously over the entire circumference of the rotary sleeve 17. Meanwhile the inside surface of the central housing 1 is formed to the true form of a cylinder and therefore the thickness of the pneumatic bearing chamber 18 will be large at the taper 35 of the rotary sleeve 17.

Figure 5:
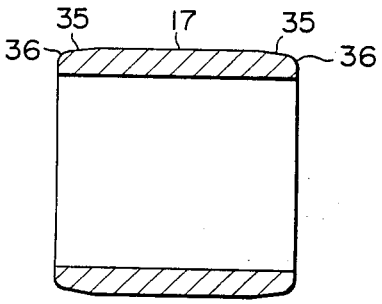
FIG. 5 is a sectional view of a rotary sleeve taken out of a rotary compressor in another embodiment of the present invention.

FIG. 5 illustrates the construction of the rotary sleeve 17 of a rotary compressor in another embodiment of the present invention.

In this embodiment too, the rotary sleeve 17 has a formed taper 35 extending from the two ends toward the axial center and continuing in the circumferential direction, and the edge of the taper 35 is rounded. The roundness 36 extends over the entire edge of the rotary sleeve 17.

Otherwise the construction is similar to the first embodiment and a detailed description is omitted with the same symbols in FIGS. 3 and 4 associated with similar parts.

Next the action in the rotary sleeve thus constructed will be described.

First the performance of the rotary compressor is described. The force from the engine is transmitted to the pulley 11, and from the pulley 11 to the rotor 2 via the rotating member 12 and the rotating shaft 3, whereupon the rotor 2 is driven. As the rotor 2 rotates, the vane 16 is pushed outward in the radial direction by the centrifugal force and is pressed against the inside surface of the rotary sleeve 17. With the rotation of the rotor 2 and the vane 16, the gas is drawn from the suction chamber 22 via the suction hole 23 into the suction side work chamber 24. The gas thus drawn into the chamber 24 reaches the exhaust side work chamber 30 with the rotation of the rotor 2 and is compressed in the clearance between the rotor 2 and the inside of the rotary sleeve 17. The clearance is progressively narrowed in the rotating direction A. The gas thus compressed is discharged from the exhaust chamber 27 through the exhaust hole 29. Between the vane 16 and the bottom of the vane groove 15 a gas is introduced through the communication hole 5 so that the vane 16 can smoothly reciprocate within the vane groove 15 and the gas is discharged through the communication hole 31.

When the friction of the rotary sleeve 17 against the vane 16 exceeds the friction of the rotary sleeve 17 against the inside surface of the central housing 1, the rotary sleeve 17 begins to rotate together with the vane 16. Then the gas travels via the inlet 19 into the pneumatic bearing chamber 18. When the rotary sleeve 17 becomes floatingly suspended in the central housing 1 by means of the pneumatic bearing, the friction between the rotary sleeve 17 and the central housing 1 is drastically reduced and a smooth rotation is obtained.

Since the gas inlet 19 is located at the start of the exhaust side work area and the gas outlet 20 is located at the end of the exhaust side work area, the gas is preferentially introduced to that part of the pneumatic bearing chamber 18 corresponding to the exhaust side area where the rotary sleeve 17 tends to be pressed against the inside surface of the central housing 1 by a high pressure in the exhaust side work chamber 30. Thus the clearance between the rotary sleeve 17 and the central housing 1 is ensured, yielding a good effect of the pneumatic bearing.

Next the action of the taper 35 in the rotary sleeve 17 is described. In the rotary sleeve 17, of which the inside heated by an adiabatically compressed gas is hotter than the outside, a thermal deformation takes place making its two ends bend outwardly, because these two ends are not restrained. However, the rotary sleeve 17 has substantially its two ends chamferred on account of the taper 35 and as a consequence said two ends are prevented from contacting the inside surface of the central housing 1. In the second embodiment, in which the tapers 35 at both ends of the rotary sleeve 17 are rounded 36, it is not possible that the two ends of the rotary sleeve 17 come at their rounded part into contact with the inside surface of the central housing 1.

Moreover, even when the rotary sleeve 17 is displaced as the result of an oscillation within the central housing 1, on account of the virtual chamfer due to the taper 35, there is no possibility of the two ends of the rotary sleeve 17 coming into contact with the inside surface of the central housing 1. When the roundness 36 is present, there can be no contact of the rounded parts. Furthermore, since the taper 35 extends continuously in the circumferential direction, the fricitional resistance, even in a possible contact with the central housing 1, will be extremely small with no occurrence of wear or scuffing.

As fully explained above, the rotary compressor according to the present invention, in which the rotary sleeve is tapered from the two ends toward the axial center, is free from the possibilities of its ends contacting the central housing as a result of its thermal deformation or displacement or wear, scuffing and seizure occurring due to such a contact. Thus a stable, smooth rotation is assured. When the taper edge is rounded, the above-mentioned effect will be further enhanced.

Although only preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention as defined by the following claims.

What is claimed is:

1. A rotary compressor comprising:

a central housing with a cavity therein the inside of said central housing being formed to a true cylinder;

a rotary sleeve rotatably floating, suspended within said housing by means of a pneumatic bearing chamber, whereby the rotary sleeve does not contact the central housing, said rotary sleeve being heated at its inner surface by adiabatic expansion of a gas and cooled at its outer surface by a gas supplied to the pneumatic chamber;

a rotor rotatably housed within said rotary sleeve and a vane free to move into and out of said rotor; and a taper formed on the outside surface of said rotary sleeve, extending continuously in the circumferential direction from both ends of its axial center, whereby no contact is made between the rotary sleeve and the central housing due to thermal deformation of the rotary sleeve.

2. The rotary compressor of claim 1, wherein said taper is inclined at less than 5/100.

3. The rotary compressor of claim 1, wherein the thickness at both ends of said rotary sleeve is more than ½ of the thickness of the taperless portion.

4. The rotary compressor of claim 1, wherein the length of each taper at each of the respective ends of said rotary sleeve is less than ½ of the total length of said rotary sleeve.

5. The rotary compressor of claim 1, wherein the edge of the rotary sleeve end of said taper is rounded.

* * * * *